US006247421B1

(12) United States Patent
Ludwigson

(10) Patent No.: US 6,247,421 B1
(45) Date of Patent: Jun. 19, 2001

(54) METHOD FOR DP-CONVERSION OF AN EXISTING SEMI-SUBMERSIBLE RIG

(75) Inventor: Robert Ludwigson, Göteborg (SE)

(73) Assignee: GVA Consultants AB, Göteborg (SE)

( * ) Notice: Subject to any disclaimer, the term of this patent is extended or adjusted under 35 U.S.C. 154(b) by 0 days.

(21) Appl. No.: 09/514,684

(22) Filed: Feb. 28, 2000

Related U.S. Application Data

(60) Provisional application No. 60/139,472, filed on Jun. 16, 1999.

(51) Int. Cl.[7] ..... B63B 35/44
(52) U.S. Cl. ..... 114/265; 114/114 B; 114/65 R
(58) Field of Search ..... 114/144 BR, 258, 114/264, 265, 266, 65 R

(56) References Cited

U.S. PATENT DOCUMENTS

| | | | | |
|---|---|---|---|---|
| 3,978,807 | * | 9/1976 | Nitzki | 114/265 |
| 4,436,050 | | 3/1984 | Liden | 114/265 |
| 5,036,782 | | 8/1991 | KInde et al. | 114/265 |

* cited by examiner

*Primary Examiner*—Jessica D. Sotelo

(74) *Attorney, Agent, or Firm*—Kilpatrick Stockton LLP

(57) ABSTRACT

A method for converting a semi-submersible drilling or accommodation rig into a dynamically positioned vessel in which the rig has pontoon bodies submergible below a surface of a body of water for producing displacement, support columns extending upright from the pontoon bodies and oriented for intersecting the surface of the body of water to define a waterline area for the rig, and a work deck supported on the support columns and arranged to be disposed at a position above the surface of the body of water. The conversion method includes prefabricating a rig extension in which the rig extension has a pontoon body extension, a work deck extension and a supplemental support structure connecting the work deck extension to the pontoon body extension. The rig extension is then connected to the semi-submersible rig at locations proximate one of the pontoon bodies and at the work deck. Thruster(s) may be optionally added at the pontoon body extension. The conversion is utilized to increase the water displacement of the rig to produce a water displacement of the converted vessel greater than the water displacement of the rig and to provide the converted vessel with a water line area greater than a water line area of the rig thereby increasing a deck-load capacity and stability of the converted vessel. Supplemental power generating and distribution equipment is installed which includes at least one diesel generator in the rig extension. The thruster is at least primarily powered by the supplemental power generating and distribution equipment.

30 Claims, 3 Drawing Sheets

METHOD FOR DP-CONVERSION OF AN EXISTING SEMI-SUBMERSIBLE RIG

RELATED PATENT APPLICATIONS

This patent application claims the benefit of U.S. Provisional Application No. 60/139,472 filed Jun. 16, 1999; the disclosure of which is expressly incorporated herein by reference.

TECHNICAL FIELD AND INDUSTRIAL APPLICABILITY

The present invention relates to a method for converting an existing moored semi-submersible drilling- or accommodation-rig including at least two submerged pontoon bodies, a work deck raised to a secure level above the surface of the water that has power generation facilities, and upright support columns between the pontoon bodies and the work deck. This structural combination is established as a dynamically positioned drilling vessel having thrusters and additional power generation and distribution facilities for station keeping; that is, stationary location of the platform in the water using the thrusters. The invention can alternatively be used for conversion of a semi-submersible rig to a dynamically positioned floating production vessel.

BACKGROUND ART

Usually, when converting an older existing moored drilling rig to a dynamically positioned (DP) drilling vessel, a number of thrusters are added to the pontoon bodies and a large amount of power generation and distribution equipment is necessarily added to the work deck. This equipment includes, among other things, diesel generators, switchboards, transformers, variable speed drives for thrusters, support equipment for the diesel generators and control equipment for keeping the rig on station.

Additionally, the drilling deck's capability for carrying load has to be increased to accommodate the DP support equipment and the possibility of additional drilling equipment. Usually the increased weight and payload are compensated for by adding sponsons to the submerged pontoon bodies and by adding fenders to the support columns. Both measures enhance the carrying and stabilizing capacity of the vessel. Also, the deck structure and the bracing system usually will have to be upgraded. All these structural alterations lead to extensive and expensive welding labor.

The integration of new thrusters into the pontoon bodies and the installation of new power generation and distribution equipment into the existing pontoon and deck layout (while at the same time meeting separation and redundancy requirements for a dynamically positioned rig) involves substantial time, complex routing and installation of piping and cables. The time schedule for performing such a conversion normally means that the existing rig must be taken out of operation for a long time period for the necessary construction to be completed.

In order for a conversion to be cost-effective, one usually desires to start with an existing, but comparatively modern drilling rig having a large deck-load capacity. Such rigs, however, are usually profitable in their normal role and original configuration and therefor are seldom cheaply available for conversion.

Other types of semi-submersible conversions are known; for example, the owner of the present invention is also the owner of the invention disclosed in U.S. Pat. No. 5,036,782 entitled Method For Converting a Semi-Submersible Vessel.

The '782 patent, however, discloses an enhancement to an existing semi-submersible drilling- or accommodation-rig for accomplishing a conversion into a floating production plant having apparatus for extracting and processing oil and/or gas, or other heavy and bulky deck loads. The disclosed apparatus and method for the conversion taught by the '782 patent, however, is distinctly different from the apparatus and method disclosed herein. Importantly, the conversion taught by the '782 patent does not enable dynamic station keeping and/or positioning.

DISCLOSURE OF THE INVENTION

The main objective of the present invention is to provide apparatus and method that can be used for a cost effective conversion to a deep water dynamic positioned drilling vessel of both modern semi-submersible rigs and older, previously less attractive rigs that had limited water-depth operating capability, but which are still suitable for conversion according to the teachings of the present invention.

According to the invention, this objective may be accomplished by the pre-fabrication of rig extensions for the corners of an existing semi-submersible rig. Such a method for converting semi-submersible rigs to dynamically positioned vessels can advantageously include: (1) adding "extensions" to both ends of existing pontoon bodies; (2) adding work deck extensions to the original work deck; (3) adding supporting structures between the new pontoon body extensions and the work deck extensions; and (4) adding thrusters at the pontoon body extensions for providing dynamic station keeping capabilities to the resulting converted vessel. Preferably, the support structures between the pontoon body extensions and the respective work deck extensions positioned thereabove are configured as columns, rendering the necessary water-line area increase required because of the additional mass of the newly added structures.

Thrusters, and a majority of the power generation and distribution equipment required for dynamic position station keeping are arranged on and in the rig extensions themselves. The rig extensions increase the displacement of the vessel in a way substantially corresponding to the dead weight of those extensions, including thrusters and power generation facilities. It also enables an increase in the water line area of the vessel so that necessary deck-load capacity and stability is achieved.

A preferred embodiment of the invention adds the new thrusters and power generation and distribution equipment that supply the required power for dynamic station keeping. The existing power generation and distribution equipment normally continues to be used primarily for powering the drilling equipment and existing rig systems, with only limited requirements for interconnection between the new and old power generation and distribution equipment.

Preferably, the supporting structures between the pontoon body extensions and the respective work deck extensions are arranged as columns which also contribute to giving the required water-line area increase. According to an optional variation to the invention, connective bracing elements may be arranged between the pontoon body extensions and/or the supporting columns.

Still another possible variation to the invention includes the utilization of existing thrusters and existing power generation and distribution equipment as one or more DP-failure backup group(s) for a converted dynamically positioned vessel.

According to a preferred variation of the invention, each rig corner extension, including a pontoon body extension, a work deck extension and the supporting structure therebetween is pre-fabricated as an integral unit with even the power generation equipment pre-installed. These integral units are attached to an existing rig in a dry dock and the systems are interconnected as necessary. These pre-fab characteristics account, at least partially, for the expedient nature of the present conversion technique.

Alternatively, the submerged pontoon bodies are extended in sections by means of habitats upon the floating existing rig. Support columns are mounted in sections onto the extensions of the submerged pontoon bodies and the work deck is extended out above the support columns. The power generation and distribution equipment are then installed and the various systems interconnected as necessary.

The general beneficial effects described above apply generally to each of the exemplary descriptions and characterizations of the structures and devices disclosed herein. The specific structures through which these benefits are delivered will be described in detail hereinbelow.

BRIEF DESCRIPTION OF THE DRAWINGS

In the following, the invention will be described in greater detail by way of examples and with reference to the attached drawings, in which.

MODE(S) FOR CARRYING OUT THE INVENTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Figure 1:
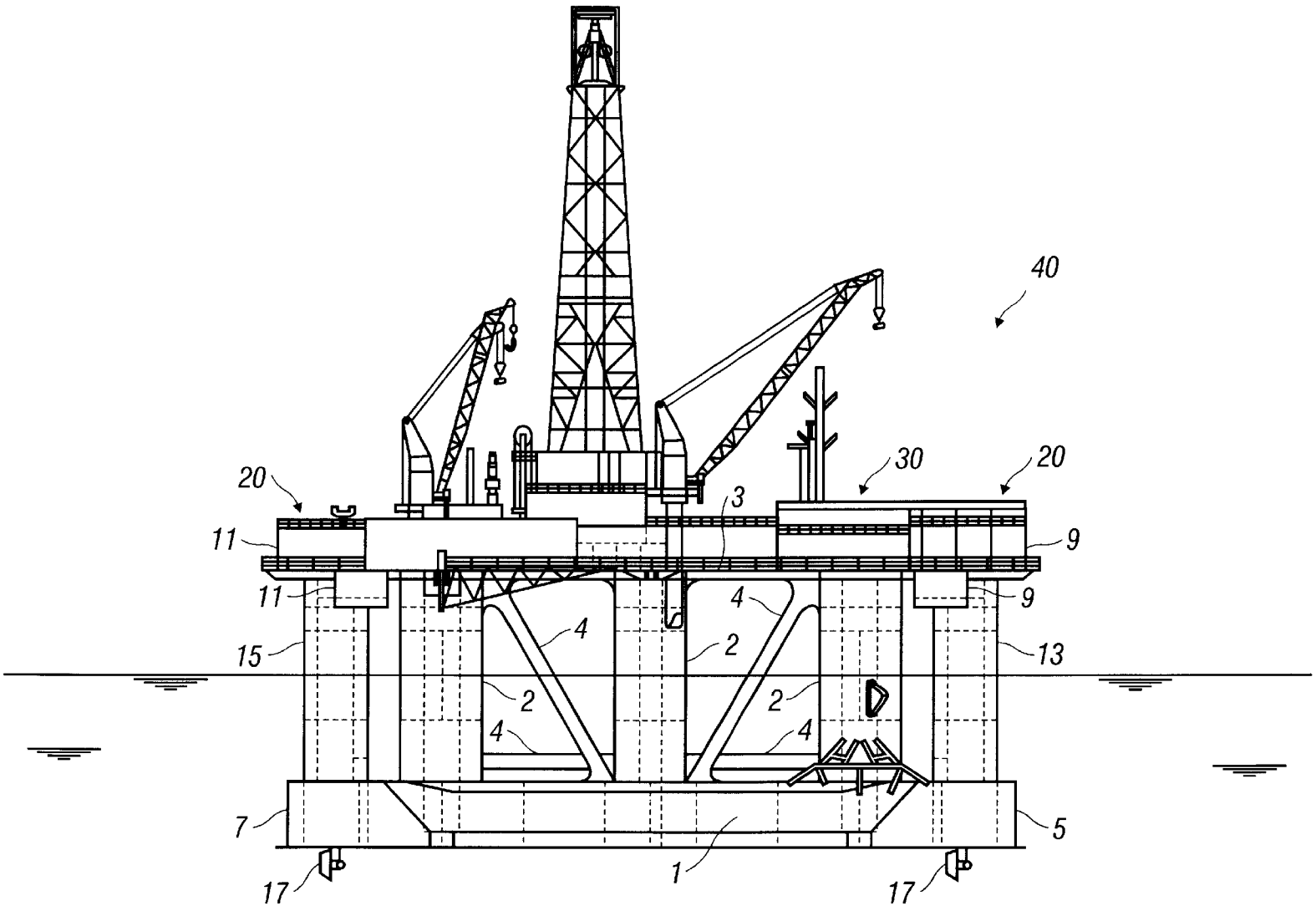
FIG. 1 is a side elevational view of a conventional semi-submersible drilling rig which has been converted into a dynamically postioned drilling vessel in accordance with the present invention.
Figure 2B:
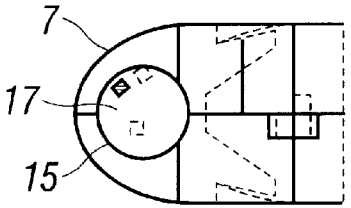
FIGS. 2*b*–2*e* demonstrate a series of different elevational cross-sectional views of is a rig extension unit; the relevant elevational references are shown and measured from the bottom of the pontoon assembly in each of these Figures.
Figure 2C:
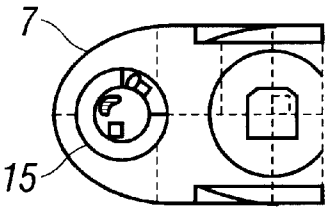
Figure 2D:
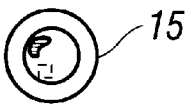
Figure 2E:
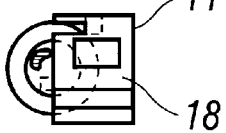
Figure 2A:
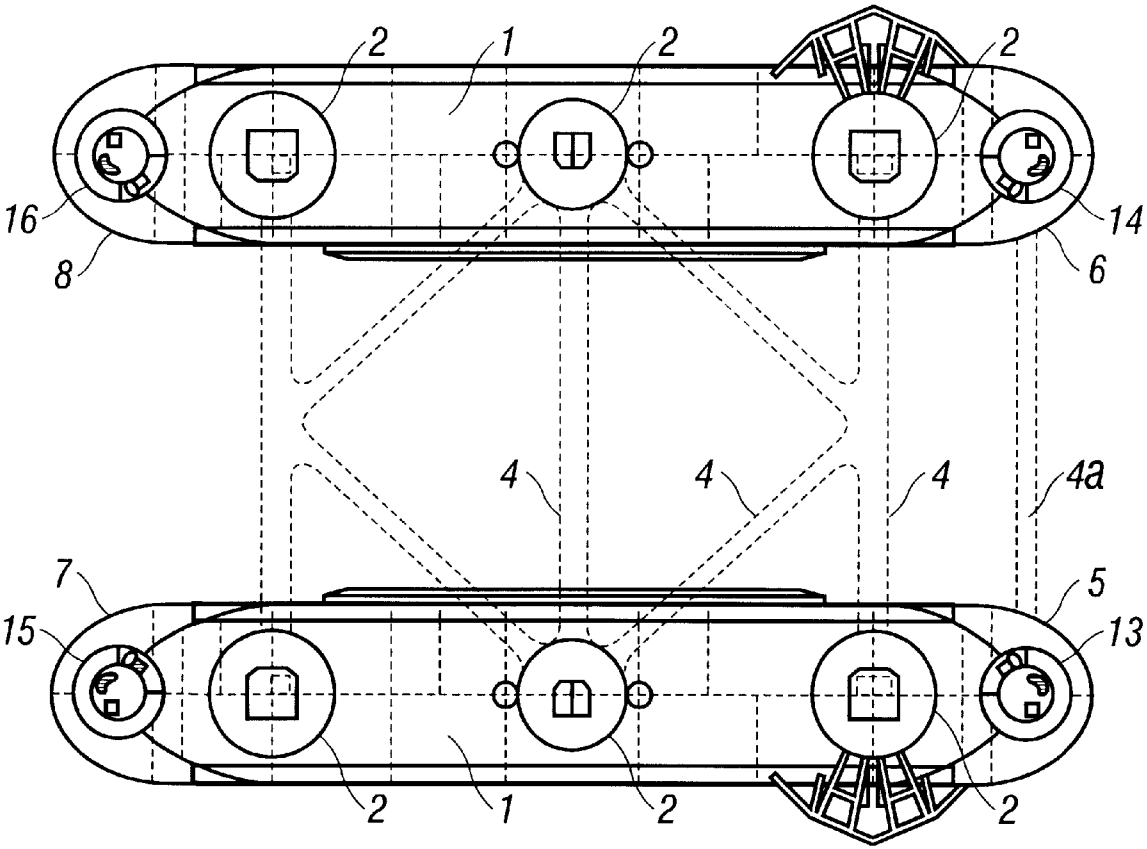
FIG. 2*a* is a top plan view of the pontoons and columns of a converted vessel viewed in a downward direction from below the deck structure. Cross-braces are shown in broken lines.
Figure 3:
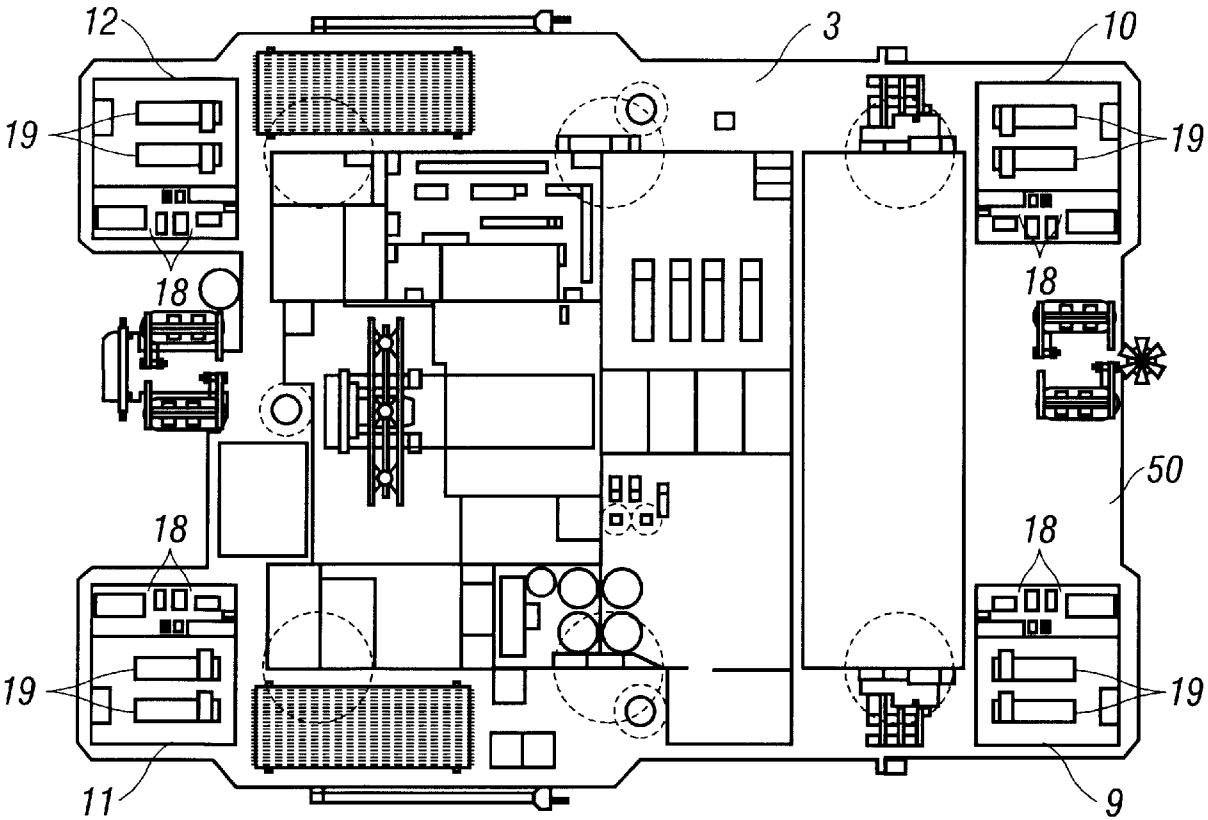
FIG. 3 is a top plan view of an exemplary deck structure of the vessel showing column positions in broken lines.

The illustrations of the semi-submersible drilling vessel found in FIGS. 1, 2 and 3 disclose at a central region of each drawing an older styled drilling rig (30) of conventional design that has two pontoons (1) and six vertical support columns (2) carried by the pontoons (1). The support columns (2) in turn carry a work deck (3) having, for example, accommodation areas, cranes and a drilling tower. A number of vertical and diagonal braces (4) run between the work deck and the pontoon bodies (1). There is a power generation and distribution system on the work deck, including diesel generators arranged for supplying power to the drilling facilities, and possibly, existing thrusters.

The left and right sides of FIGS. 1, 2, and 3 show rig extensions (20), one at each corner of the rig (30) and each having pontoon body extensions (5,6,7,8) and work deck extensions (9,10,11,12) which are supported upon the pontoon body extensions (5,6,7,8) by supplemental support structures or columns (13,14,15,16). Additional thrusters (17) are located at the pontoon body extensions (5,6,7,8) for dynamic positioning of the resulting dynamically positioned vessel (40). Power generation and distribution equipment (18), including additional diesel generators (19), are located on the work deck extensions (9,10,11,12) and are interconnected with the thrusters (17) for their power and control.

Figure 4:
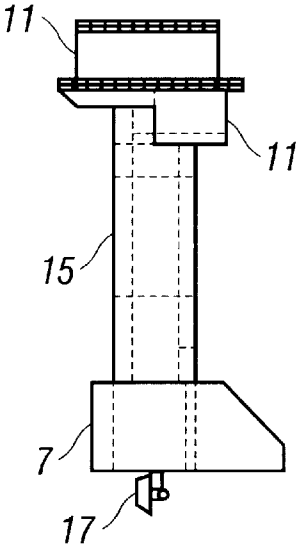
FIG. 4 is a side elevational view of a single rig extension unit adapted for incorporation upon a corner of an existing semi-submersible rig.

FIG. 4 shows a rig extension unit (20) configured to be added to a semi-submersible rig (30) as part of a conversion to a dynamically positioned vessel (40) according to the teachings of the present invention. The extension unit (20) includes a pontoon body extension (7) and a supplemental support column (15) running up to a deck extension (11). As a result, the rig extensions (20) increase the displacement of the vessel (30) while the supplemental support columns (13,14,15,16) increase the water-line area thereby giving additional stability to a converted vessel (40).

A consequence of the modification, however, is that the increased vessel displacement results in increased wave-loading on the vessel (40). One variation to combat this increased loading is to provide additional braces (4) between the original support columns (2) and optionally, cross bracing elements (4*a*) fitted between the rig extensions (20). The braces (4) and/or cross elements (4*a*) are utilized to reduce stress loads in the vessel (40).

Another possible variation to the invention is to interconnect the work deck extensions (9,10,11,12) by a spanning member (50) coupled therebetween. This increases the overall work deck area and provides additional space for power generation and distribution equipment (18) needed for the new thrusters (17), as well as drilling equipment and other typical accessories found on platform vessels.

Additional diesel generators (19) are provided in the conversion and are primarily used for powering a respective new thruster (17) located at the same corner of the vessel (40), while existing diesel generators are retained for powering drilling and other operating facilities. Each of the new rig extensions (20) has its own independent high voltage switchboard as part of the power generation and distribution plant (18), thereby rendering an IMO DP-class 3 system in which each rig extension unit (20) serves as a DP-failure group. These switchboards are normally fed from a respective high voltage switchboard, but can also be fed from an existing central switchboard.

A possible variation to the invention is that the new high voltage switchboards, and possibly also the existing central switchboard, can be electrically interconnected to D distribute the electrical loading between the different switchboards. In this case, an IMO DP-class 2 system is achieved.

The cost for converting an existing rig (30) can be minimized utilizing the presently disclosed methods and structures because the rig extensions (20) can be prefabricated and pre-outfitted and then attached to an existing rig (30) inside a dry dock so that the existing rig (30) does not have to be taken out of operation for, perhaps, more than three months. This advantageously compares with a conventional conversion undertaking in which the semi-submersible rig (30) is taken out of operation for, perhaps, as long as 12 to 24 months.

From another perspective, the present invention addresses methods for converting a semi-submersible drilling or accommodation rig (30) into a dynamically positioned vessel (40). As earlier described, the pre-existing semi-submersible rig (30) has pontoon bodies (1) submergible below a surface of a body of water for producing displacement. Support columns (2) extend upright from the pontoon bodies (1) and are oriented for intersecting the surface of the body of water to define a waterline area for the semi-submersible rig (30). A work deck (3) is supported on the support columns (2) and arranged to be disposed at a position above the surface of the body of water. The conversion method includes prefabricating a rig extension (20) having a pontoon body extension (5), a work deck extension (9) and a supplemental support structure (13) connecting the work deck extension (9) to the pontoon body extension (5). The rig extension (20) is connected to the semi-submersible rig (30) at locations proximate the pontoon bodies (1) and proximate the work deck (3). A thruster (17) is furnished at the pontoon body extension (5) for providing dynamic station keeping capabilities to the converted vessel (40). In a preferred embodiment, a set of four such rig extensions are fabricated, each adapted to be connected to one of four distal ends of the pontoon bodies (1). Preferably, and as illustrated in FIGS. 1 and 2, the rig extensions (20), together D with the original pontoon bodies (1), form substantially continuous and lengthened pontoon structures for the dynamically positioned converted vessel (40).

A consequence of the conversion is the ability to utilize the installation of the rig extension (20) to increase a water displacement of the converted vessel (40) to a greater value than a water displacement of the semi-submersible rig (30) and to also increase a water line area of the converted vessel (40) to a greater value than a water line area of the semi-submersible rig (30).

In the preferred embodiment that utilizes four rig extensions (20), each extension (20) is positioned at one of four distal ends of the pontoon bodies (1).

Supplemental power generating and distribution equipment (18) is installed, including at least one diesel generator (19), at the rig extension (20). Each thruster (17) is at least primarily powered by the supplemental power generating and distribution equipment (18) installed proximate to the respective rig extension (20). In this context, "primarily" should be considered to be fifty percent. For simplicity and redundancy, each thruster (17) is preferably entirely powered by the supplemental power generating and distribution equipment (18) installed at the same rig extension (20) to which that thruster (17) is connected.

For increased structural strength in the resulting dynamically positioned converted vessel (40), cross bracing elements (4*a*) may be provided between two of the rig extensions (20). This supplemental bracing may be optionally between the pontoon body extensions (5,6,7,8) or the supplemental support structures (13,14,15,16), or other cross-extension configurations.

For enhanced deck capacity, a work deck extension spanner (50) may be provided substantially between two work deck extensions (9,10,11,12) thereby increasing a useable area of the work deck of the converted vessel (40) in comparison to a useable area of the work deck of the semi-submersible rig (30) prior to conversion.

In a preferred configuration, the rig extension (20) is prefabricated as an integral rig extension unit including the pontoon body extension (5,6,7,8), the work deck extension (9,10,11,12), the supplemental support structure (13,14,15,16), and the thruster (17). In a preferred method of installation, each rig extension unit (20) is installed upon the semi-submersible rig (30) as a one-piece unit.

Although the present invention has been described and illustrated in detail, it is to be clearly understood that the same is by way of illustration and example only, and is not to be taken as a limitation. The spirit and scope of the present invention are to be limited only by the terms of any claims presented hereafter. For example, the rig extension units (20) do not have to be pre-fabricated as integral units, but can instead be built in sections on an existing rig (30). Further, dry-docking may be avoided if habitats are used for assembling the sections. Also, as an additional enhancement, the rig extensions (20) can be equipped with their own systems for handling of ballast, or alternatively, systems that are integrated with the original rig's (30) systems. Similar interconnections between other support systems of the new extensions (20) of the new vessel (40) and the original rig (30) are contemplated.

What is claimed and desired to be secured by Letters Patent is as follows:

1. A method for providing a prefabricated rig extension utilizable for converting a semi-submersible drilling or accommodation rig into a dynamically positioned vessel wherein such a semi-submersible rig to be converted has pontoon bodies submergible below a surface of a body of water for producing displacement, support columns extending upright from said pontoon bodies and oriented for intersecting the surface of the body of water to define a waterline area for said semi-submersible rig, and a work deck supported on said support columns and arranged to be disposed at a position above the surface of the body of water, said method for providing a prefabricated rig extension comprising the steps of:

constructing a prefabricated rig extension, said rig extension comprising a pontoon body extension and a thruster connected thereto, said thruster adapted for providing dynamic station keeping capabilities to a converted vessel; and adapting said prefabricated rig extension to be connected to said semi-submersible rig at a location proximate the pontoon bodies.

2. The method as recited in claim 1, further comprising:

constructing at least three additional prefabricated rig extensions thereby forming a set of four rig extensions, each of said rig extensions comprising a pontoon body extension and a thruster connected thereto, said thrusters being adapted to provide dynamic station keeping capabilities to a converted vessel; and adapting each of said prefabricated rig extensions to be connected to said semi-submersible rig at an end portion of the pontoon bodies.

3. The method as recited in claim 1, further comprising:

constructing said rig extension to include a work deck extension and a supplemental support structure connecting said work deck extension to said pontoon body extension; and adapting said prefabricated rig extension to be connected to said semi-submersible rig at a location proximate said work deck.

4. The method as recited in claim 3, wherein said step of adapting said prefabricated rig extension to be connected to said semi-submersible rig at locations proximate one of the pontoon bodies and the work deck further comprises:

configuring said rig extension to be connected to said rig at a distal end of one of the pontoon bodies.

5. The method as recited in claim 3, further comprising:

installing supplemental power generating and distribution equipment, including at least one diesel generator, in said rig extension.

6. The method as recited in claim 5, further comprising:

powering said thruster at least primarily by said supplemental power generating and distribution equipment installed in said rig extension.

7. The method as recited in claim 5, further comprising:

powering said thruster exclusively by said supplemental power generating and distribution equipment installed in said rig extension.

8. A method for converting a semi-submersible drilling or accommodation rig into a dynamically positioned vessel, said semi-submersible rig having pontoon bodies submergible below a surface of a body of water for producing displacement, support columns extending upright from said pontoon bodies and oriented for intersecting the surface of the body of water to define a waterline area for said semi-submersible rig, and a work deck supported on said support columns and arranged to be disposed at a position above the surface of the body of water, said method of conversion comprising the steps of:

prefabricating a rig extension, said rig extension comprising a pontoon body extension, a work deck extension and a supplemental support structure connecting said work deck extension to said pontoon body extension;

connecting said rig extension to said semi-submersible rig at locations proximate said pontoon bodies and proximate said work deck; and furnishing a thruster at said pontoon body extension for providing dynamic station keeping capabilities to said converted vessel.

9. The method as recited in claim 8, where said rig extension is prefabricated as an integral rig extension unit including said pontoon body extension, said work deck extension, said supplemental support structure, and said thruster.

10. The method as recited in claim 9, further comprising:

installing said integral rig extension unit upon said semi-submersible rig as a one-piece unit.

11. The method as recited in claim 8, further comprising:

utilizing the installation of said rig extension to increase a water displacement of said converted vessel to greater than a water displacement of said semi-submersible rig prior to conversion and to increase a water line area of said converted vessel to greater than a water line area of said semi-submersible rig prior to conversion.

12. The method as recited in claim 11, further comprising:

positioning said rig extension substantially at a distal end of one of said pontoon bodies; and connecting at least three additional rig extensions at other distal ends of said pontoon bodies.

13. The method as recited in claim 12, further comprising:

forming a substantially continuous and lengthened pontoon for said vessel by adding rig extensions at each of two ends of a pontoon body of said semi-submersible rig.

14. The method as recited in claim 12, further comprising:

providing cross bracing elements between two of said rig extensions.

15. The method as recited in claim 12, further comprising:

providing cross bracing elements between two of said pontoon body extensions.

16. The method as recited in claim 12, further comprising:

providing cross bracing elements between two of said supplemental support structures.

17. The method as recited in claim 12, further comprising:

providing a work deck extension spanner substantially between two rig extensions thereby increasing a useable area of said work deck of said converted vessel in comparison to a useable area of said work deck of said semi-submersible rig prior to conversion.

18. The method as recited in claim 11, further comprising:

installing supplemental power generating and distribution equipment, including at least one diesel generator, at said rig extension.

19. The method as recited in claim 18, further comprising:

powering said thruster at least primarily by said supplemental power generating and distribution equipment installed at said rig extension.

20. The method as recited in claim 18, further comprising:

powering said thruster entirely by said supplemental power generating and distribution equipment installed at said rig extension.

21. A method for converting a semi-submersible drilling or accommodation rig into a dynamically positioned vessel, said semi-submersible rig having at least two pontoon bodies submerged below the surface of a body of water to produce displacement, a plurality of support columns extending upright from said at least two pontoon bodies and intersecting the surface of said body of water to define a waterline area for said rig, and a work deck, including an accommodation area and a work area, arranged on said plurality of support columns and disposed at a level above the surface of said body of water, said method of conversion comprising the steps of:

prefabricating at least four rig extensions, said rig extensions each comprising a pontoon body extension, a work deck extension and a supplemental support structure supporting the work deck extension on the pontoon body extension;

providing at least one thruster on each pontoon body extension;

connecting one each of said rig extensions at ends of said at least two pontoon bodies of said semi-submersible rig so that said pontoon body extensions are positioned at a level proximate a level of said pontoon bodies and said work deck extensions are positioned at a level proximate a level of said work deck;

increasing said rig water displacement to produce a water displacement of said converted vessel greater than said rig displacement; and providing said vessel with a water line area greater than said water line area of said rig thereby increasing the deck-load capacity and stability of said vessel.

22. The method as recited in claim 21, wherein power generating and distribution equipment, including at least one diesel generator, is arranged on each of said work deck extensions.

23. The method as recited in claim 21, wherein said rig extensions are provided with connecting elements between two of said pontoon body extensions or between two of the structures supporting said work deck extensions on said respective pontoon body extensions.

24. The method as recited in claim 21, wherein two of said work deck extensions are provided with a work deck extension spanner therebetween.

25. The method as recited in claim 21, wherein said step of providing a structure supporting said work deck extension on said pontoon body extension further comprises providing said vessel with a water line area greater than the water line area of said rig and assembling additional supporting columns to said vessel.

26. The method as recited in claim 21, wherein said rig extensions are prefabricated as integral units including said pontoon body extensions, said work deck extensions and said structures supporting said work deck extensions on said pontoon body extensions, and wherein said integral units are connected to said rig.

27. The method as recited in claim 21, wherein said pontoon body extensions are connected to each end of at least two pontoon bodies of said rig, said supporting structures are assembled onto said pontoon body extensions, and said work deck extension is assembled onto said supporting structures.

28. The method as recited in claim 21, wherein said thrusters are primarily powered through a power generation and distribution system in said respective rig extension, by said, at least one, generator on said respective work deck extension above said respective pontoon body extension.

29. The method as recited in claim 28, wherein said power generation and distribution systems in said rig extensions, are interconnected and connected to the existing power generating and distribution system on said rig.

30. The method as recited in claim 28, wherein said existing power generation and distribution system on said existing rig, is one or more DP-failure group(s) for the converted vessel.

* * * * *